US011660880B2

(12) United States Patent
Lin et al.

(10) Patent No.: US 11,660,880 B2
(45) Date of Patent: May 30, 2023

(54) DIGITAL PRINTING PRESS

(71) Applicant: Guangzhou Pulisi Technology Co., Ltd., Guangdong (CN)

(72) Inventors: Xiaobo Lin, Guangdong (CN); Lu Liu, Guangdong (CN); Zhenhua Meng, Guangdong (CN)

(73) Assignee: Guangzhou Pulisi Technology Co., Ltd., Guangzhou (CN)

( * ) Notice: Subject to any disclaimer, the term of this patent is extended or adjusted under 35 U.S.C. 154(b) by 33 days.

(21) Appl. No.: 17/540,208

(22) Filed: Dec. 1, 2021

(65) Prior Publication Data

US 2022/0410596 A1 Dec. 29, 2022

(30) Foreign Application Priority Data

Jun. 28, 2021 (CN) ..... 202110720341.6

(51) Int. Cl.
*B41J 11/00* (2006.01)

(52) U.S. Cl.
CPC ..... *B41J 11/00212* (2021.01)

(58) Field of Classification Search
CPC ..... B41J 11/00212; B41J 2203/01; B41J 11/0045; B41J 11/0085; B41J 15/04; B41J 11/00214; B41J 3/543; B41J 2/21; B41J 11/0015; B41J 29/393; B41J 11/02; B41J 11/002
See application file for complete search history.

(56) References Cited

U.S. PATENT DOCUMENTS

2013/0215202 A1* 8/2013 Koller ..... B41J 11/00214 347/102

* cited by examiner

*Primary Examiner* — Bradley W Thies

(57) ABSTRACT

The present disclosure relates to the technical field of printing, and provides a digital printing press. The digital printing press includes a frame, and an unwinder, a driver, an inkjet printer, a curer and a winder that are arranged on the frame, where the driver drives a substrate to move from the unwinder to the winder along a substrate path, the inkjet printer and the curer are arranged above a printing segment of the substrate path, the printing segment of the substrate path is in the shape of an arch, and the arch bends toward the inkjet printer and the curer. The UV light from the curer can be reflected by the substrate to a position other than the inkjet printer as a result of the arched printing segment. UV light is prevented from entering the inkjet printer's nozzle, extending the inkjet printer's service life.

10 Claims, 3 Drawing Sheets

DIGITAL PRINTING PRESS

CROSS REFERENCE TO RELATED APPLICATIONS

The present application claims the benefit of Chinese Patent Application No. 202110720341.6 filed on Jun. 28, 2021, the contents of which are incorporated herein by reference in their entirety.

TECHNICAL FIELD

The present disclosure relates to the technical field of printing, and in particular, to a digital printing press.

BACKGROUND

During printing, a substrate is typically provided on a plane; the nozzle of an inkjet printer passes over the substrate to print on it. In order to improve the printing quality, a curer, usually an ultraviolet lamp, is often provided to irradiate and cure the substrate after printing is completed. However, some of the ultraviolet light that is irradiated onto the printed matter is reflected back to the nozzle, shortening the service life of the nozzle.

SUMMARY

An objective of the present disclosure is to provide a digital printing press that reduces the quantity of UV light reflected into the inkjet printer, hence reducing inkjet printer wear.

To achieve the above-mentioned objective, the present disclosure provides a digital printing press, including a frame, and an unwinder, a driver, an inkjet printer, a curer and a winder provided at the frame, where the driver drives a substrate to move from the unwinder to the winder along a substrate path, the inkjet printer and the curer are arranged above a printing segment of the substrate path, the printing segment of the substrate path is in the shape of an arch, and the arch bends toward the inkjet printer and the curer.

Optionally, the digital printing press may be provided with multiple pairs of inkjet printers and curers, and each pair may include one curer and one inkjet printer that are adjacent to each other.

Optionally, the digital printing press may further include an air suction plate installed at the frame, and the air suction plate may be provided at the printing segment of the substrate path and under the curer.

Optionally, the digital printing press may further include a first guide roller installed at the frame, and the first guide roller may be adjacent to the air suction plate.

Optionally, the digital printing press may further include a deviation correction device on the frame, and the deviation correction device may be provided at the substrate path and between the unwinder and the inkjet printer.

Optionally, the digital printing press may further include a corona device installed at the frame, the corona device may be provided at the substrate path and between the deviation correction device and the inkjet printer.

Optionally, the digital printing press may further include a dust remover installed at the frame, the dust remover may be provided at the substrate path and between the corona device and the inkjet printer.

Optionally, the digital printing press may further include a detector installed at the frame, and the detector may be provided at the substrate path and between the curer and the winder.

Optionally, the digital printing press may further include a controller installed at the frame, and the controller may be electrically connected to the detector and the driver respectively.

Optionally, the digital printing press may further include a workbench installed at the frame, and the workbench may be provided at the substrate path and between the detector and the winder.

Compared with the prior art, the digital printing press provided by the present disclosure has the following beneficial effects:

In the digital printing press provided by the present disclosure, the substrate unwound by the unwinder passes by the inkjet printer and the curer along the substrate path to undergo inkjet printing and curing, and is then wound by the winder. The UV light from the curer can be reflected by the substrate to a position other than the inkjet printer as a result of the arched printing segment of the substrate path located beneath the inkjet printer and the curer. UV light is prevented from entering the inkjet printer's nozzle in this manner, extending the inkjet printer's service life.

In the figures: 1. Frame, 2. Unwinder, 3. Inkjet printer, 4. Curer, 5. Winder, 6. Substrate path, 7. Deviation correction device, 8. Corona device, 9. Dust remover, 10. Detector, 11. Workbench, 12. First guide roller, 13. Second guide roller, 14. Air suction plate, 15. Driver, and 16. Printing segment.

DETAILED DESCRIPTION

The specific implementations of the present disclosure are described in more detail below with reference to the accompanying drawings and embodiments. The following embodiments are for illustrative purposes only and do not limit the scope of the present disclosure.

It should be understood that in the description of the present disclosure, terms such as "central", "longitudinal", "transverse" "upper", "lower", "front", "rear", "left", "right" "vertical", "horizontal", "top", "bottom", "inside" and "outside" indicate the orientation or position relationships based on the drawings. They are merely intended to facilitate and simplify the description of the present disclosure, rather than to indicate or imply that the mentioned device or components must have a specific orientation or must be constructed and operated in a specific orientation. Therefore, these terms should not be construed as a limitation to the present disclosure. Moreover, the terms "first", "second" and "third" are used only for the purpose of description, rather than to indicate or imply relative importance.

In the description of the present disclosure, it should be noted that, unless otherwise clearly specified, meanings of terms "install", "connected with", and "connected to" should be understood in a broad sense. For example, the connection may be a fixed connection, a removable connection, or an integral connection; may be a mechanical connection or an electrical connection; may be a direct connection or an indirect connection by using an intermediate medium; or may be intercommunication between two components. A person of ordinary skill in the art may understand the specific meanings of the above terms in the present disclosure based on the specific situation.

In addition, in the description of the present disclosure, unless otherwise specified, "a plurality of" means at least two.

The person of ordinary skill in the art may understand the specific meanings of the above terms in the present disclosure based on the specific situation.

Figure 1:
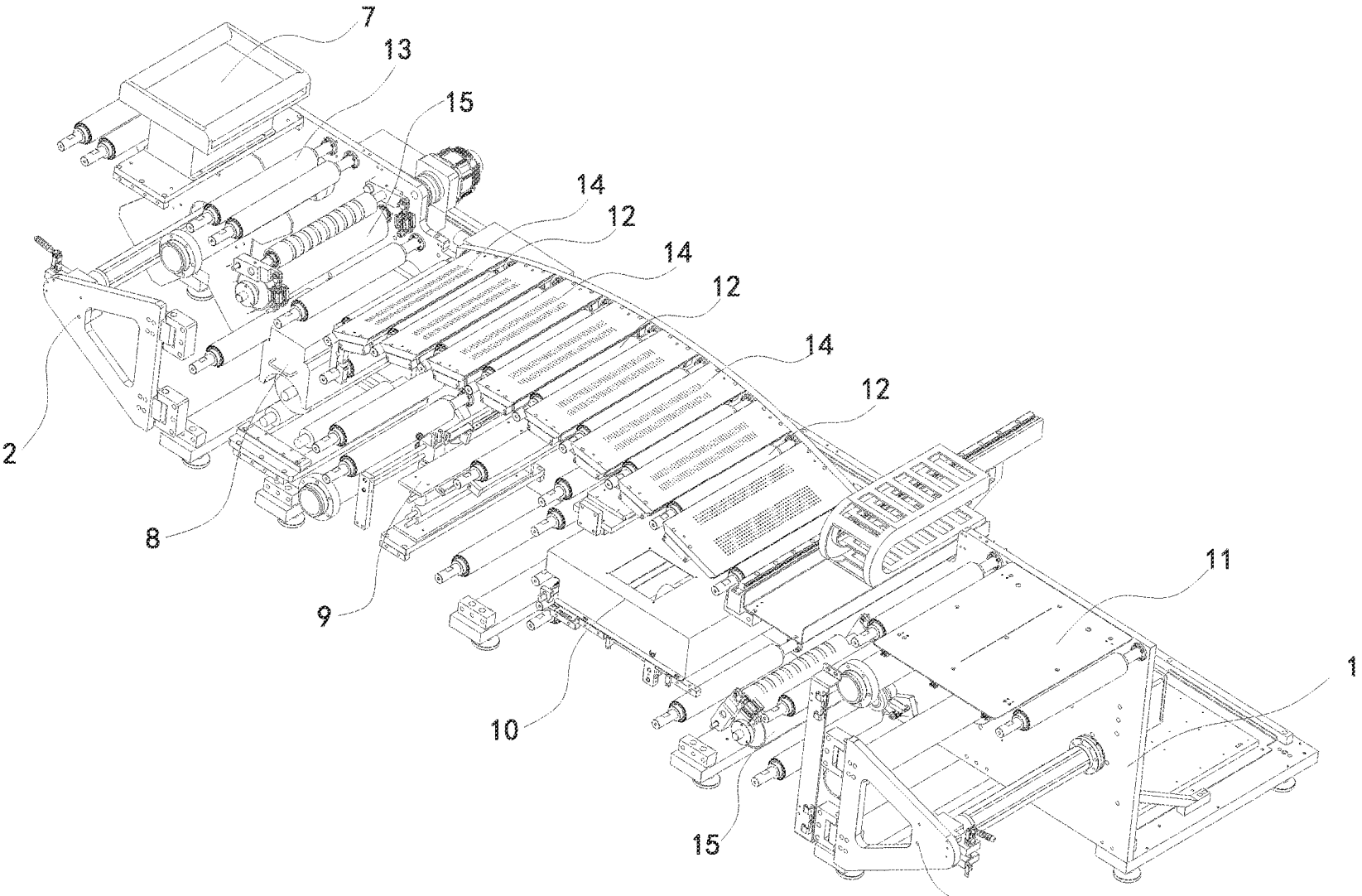
FIG. 1 is a schematic structural view of an embodiment of the present disclosure (the inkjet printer and the curer are not shown).
Figure 2:
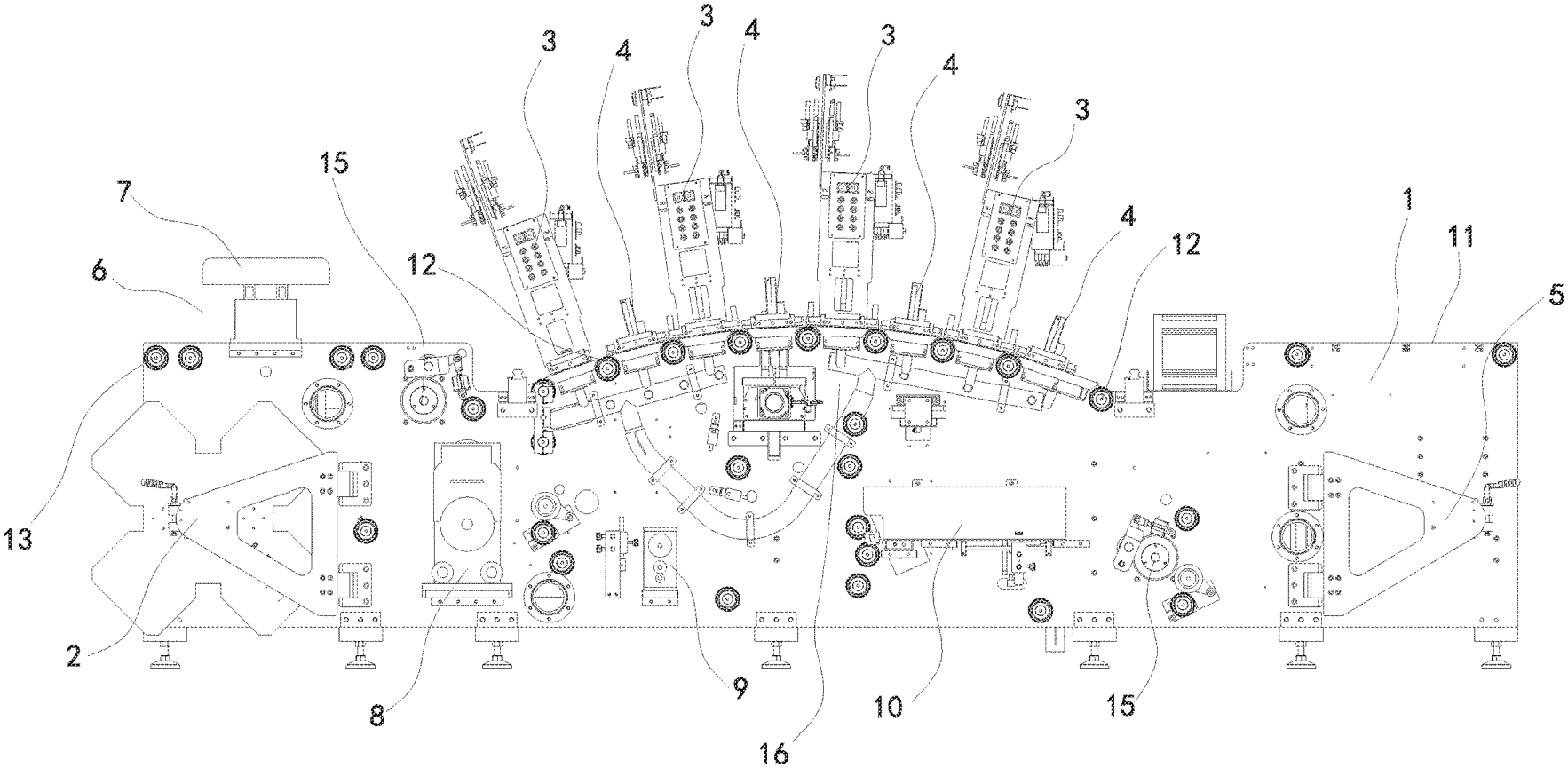
FIG. 2 is a front view of an embodiment of the present disclosure.
Figure 3:
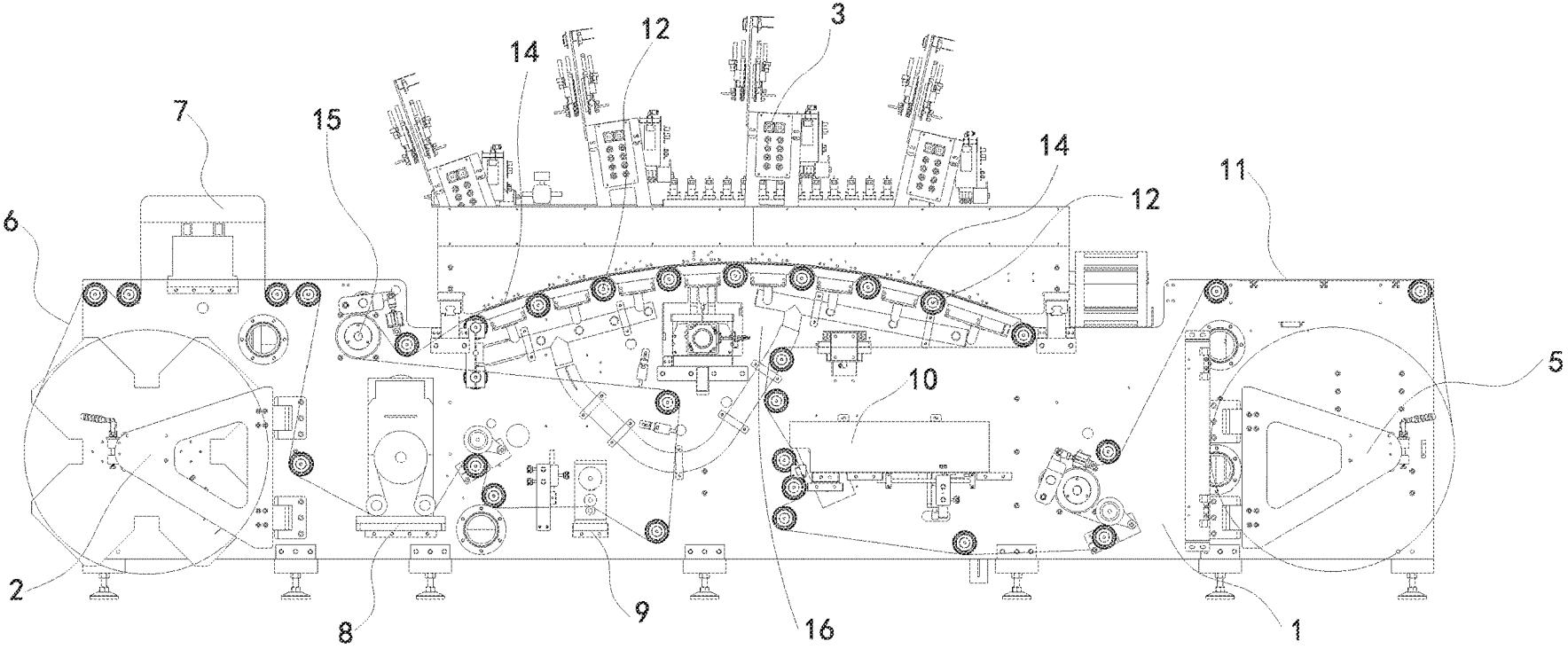
FIG. 3 is a schematic view of a substrate path of an embodiment of the present disclosure.

Referring to FIGS. 1-3, a preferred embodiment of the digital printing press of the present disclosure comprises a frame 1, and an unwinder 2, a driver 15, an inkjet printer 3, a curer 4 and a winder 5 provided at the frame 1. the driver 15 drives a substrate to move from the unwinder 2 to the winder 5 along a substrate path 6, the inkjet printer 3 is provided above the substrate path 6; the curer 4 is provided above the substrate path 6 and between the inkjet printer 3 and the winder 5. The segment of the substrate path 6 below the inkjet printer 3 and the curer 4 (that is, a printing segment 16 of the substrate path 6) is in the shape of an arch, and the arch bends toward the inkjet printer 3 and the curer 4. At unwinder 21, an unprinted substrate roll is provided, which is unwound during the printing operation; after printing, the printed substrate is wound by the winder 5. Specifically, referring to FIG. 3, the substrate unwound by unwinder 2 travels along substrate path 6, passing by inkjet printer 3 for inkjet printing and curer 4 for curing of the printed pattern, before being wound by winder 5. The UV light from curer 4 can be reflected by the substrate to a position other than the inkjet printer 3 as a result of the arched printing segment 16. UV light is prevented from entering the nozzle of inkjet printer 3 in this manner, extending the inkjet printer's service life.

It should be noted that multiple pairs of inkjet printers 3 and curers 4 can be provided. In each pair, the curer 4 and the inkjet printer 3 are adjacently arranged. The multiple pairs of inkjet printers 3 and curers 4 allow the printing of a range of patterns in various colors and designs by one printing device. After the inkjet printer 3 prints a pattern, the adjacent curer 4 cures the pattern to ensure that the printed matter is of high quality. In this embodiment, there are four pairs of inkjet printers 3 and curers 4.

It should be noted that the digital printing press in the embodiment further includes an air suction plate 14 installed at the frame 1, and the air suction plate 14 is provided at the substrate path 6 and under the curer 4. When the substrate passes by the air suction plate 14 while traveling along the substrate path 6, the air suction plate 14 holds the substrate in place due to air suction through numerous air suction holes on the air suction plate 14. A fan and an air delivery pipe are also installed at the frame 1, the fan communicates with the air suction holes through the air delivery pipe. When the fan is in operation, air is drawn into the air delivery pipe through the air suction holes and is then pumped out. The digital printing press further includes first guide rollers 12 installed at the frame 1. The first guide rollers 12 are positioned on both sides of the air suction plate 14, allowing the substrate to move steadily on the air suction plate 14 while preventing the substrate from becoming stuck due to the suction force exerted by the air suction plate 14. Multiple second guide rollers 13 are also installed on the frame 1. The second guide rollers 13 are all provided along the substrate path 6 to assist the movement of the substrate along the substrate path 6.

In addition, the digital printing press of the embodiment further includes a deviation correction device 7 installed at the frame 1 the. The deviation correction device 7 is provided at the substrate path 6 and between the unwinder 2 and the inkjet printer 3. The deviation correction device 7 ensures that the pattern can be printed at a preset position in the subsequent inkjet printing process by correcting the position of the substrate. The digital printing press further includes a corona device 8 installed at the frame 1, the corona device 8 is provided at the substrate path 6 and between the deviation correction device 7 and the inkjet printer 3. Prior to printing, the substrate is subjected to corona treatment to increase its surface roughness. As a result of the increased surface area, the printing ink desirably wets and sticks to the roughened substrate. The digital printing press further includes a dust remover 9 installed at the frame. The dust remover 9 is provided at the substrate path 6 and between the corona device 8 and the inkjet printer 3. Dust on the substrate is removed prior to printing and after the corona treatment to improve printing quality.

The digital printing press in the embodiment further includes a detector 10 installed at the frame 1, the detector 10 is provided at the substrate path 6 and between the curer 4 and the winder 5. The detector 10 is configured to detect defective printed matter. The digital printing press further includes a controller installed at the thee 1. The controller is electrically connected to both the detector 10 and the driver 15. The controller can determine the quality of the printed matter and control the operation state of the driver 15. The controller may be a programmable logic controller (PLC) single-chip microcomputer. The digital printing press further includes a workbench 11 installed at the frame 1, the workbench 11 is provided at the substrate path 6 and between the detector 10 and the winder 5. In the embodiment, when the printed matter passes by the detector 10, the detector 10 sends image information of the printed matter to the controller, and the controller determines whether the quality of the present printed matter is acceptable. When the printing quality is deemed acceptable, the driver 15 continues to drive the movement of the substrate, and the printed matter is then wound by the winder 5. When the printing quality is deemed unacceptable, the driver 15 comes to a halt, and the printed matter is left on the workbench 11 to be processed by the user.

In the embodiment, the driver 15 consists of two traction rollers installed at the frame 1. One traction roller is provided at the substrate path 6, between the dust remover 9 and the inkjet printer 3; the other traction roller is provided at the substrate path 6, between the detector 10 and the workbench 11.

To conclude, the digital printing press provided by the embodiment of the present disclosure reduces the quantity of light reflected into the inkjet printer 3, hence reducing inkjet printer wear.

The above merely describes preferred implementations of the present disclosure. It should be noted that several improvements and replacements may further be made by the person of ordinary skill in the art without departing from the technical principle of the present disclosure, and these improvements and replacements should also be considered within the protection scope of the present disclosure.

The invention claimed is:

1. A digital printing press, comprising a frame, and an unwinder, a driver, an inkjet printer, a curer and a winder provided at the frame, wherein the driver drives a substrate to move from the unwinder to the winder along a substrate path, the inkjet printer and the curer are arranged above a printing segment of the substrate path, the printing segment of the substrate path is in the shape of an arch, and the arch bends toward the inkjet printer and the curer.

2. The digital printing press according to claim 1, wherein the digital printing press is provided with multiple pairs of inkjet printers and curers, and each pair of inkjet printer and curer comprises one curer and one inkjet printer that are adjacent to each other.

3. The digital printing press according to claim 2, further comprising an air suction plate installed at the frame, and the air suction plate is provided at the printing segment of the substrate path and under the curer.

4. The digital printing press according to claim 3, further comprising a first guide roller installed at the frame, and the first guide roller is adjacent to the air suction plate.

5. The digital printing press according to claim 1, further comprising a deviation correction device installed at the frame, the deviation correction device is provided at the substrate path and between the unwinder and the inkjet printer.

6. The digital printing press according to claim 5, further comprising a corona device installed at the frame, the corona device is provided at the substrate path and between the deviation correction device and the inkjet printer.

7. The digital printing press according to claim 6, further comprising a dust remover installed at the frame, the dust remover is provided at the substrate path and between the corona device and the inkjet printer.

8. The digital printing press according to claim 1, further comprising a detector installed at the frame, the detector is provided at the substrate path and between the curer and the winder.

9. The digital printing press according to claim 8, further comprising a controller installed at the frame, and the controller is electrically connected to the detector and the driver.

10. The digital printing press according to claim 8, further comprising a workbench installed at the frame, and the workbench is provided at the substrate path and between the detector and the winder.

* * * * *